US008458914B2

(12) United States Patent
Voorhorst et al.

(10) Patent No.: US 8,458,914 B2
(45) Date of Patent: Jun. 11, 2013

(54) SHAVING DEVICE COMPRISING A PIVOTABLY ARRANGED ASSEMBLY OF CUTTING ELEMENTS

(75) Inventors: Fokke Roelof Voorhorst, Drachten (NL); Bastiaan Johannes De Wit, Drachten (NL); Alastair Ian Blake, Drachten (NL); Johan Pragt, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 327 days.

(21) Appl. No.: 12/808,481

(22) PCT Filed: Dec. 5, 2008

(86) PCT No.: PCT/IB2008/055113

§ 371 (c)(1),
(2), (4) Date: Jun. 16, 2010

(87) PCT Pub. No.: WO2009/081301

PCT Pub. Date: Jul. 2, 2009

(65) Prior Publication Data

US 2010/0299930 A1 Dec. 2, 2010

(30) Foreign Application Priority Data

Dec. 20, 2007 (EP) ..... 07123744

(51) Int. Cl.
*B26B 19/06* (2006.01)
*B26B 19/04* (2006.01)

(52) U.S. Cl.
USPC ..... 30/210; 30/43.92

(58) Field of Classification Search
USPC ..... 30/43.2, 208, 210, 216–220, 527
See application file for complete search history.

(56) References Cited

U.S. PATENT DOCUMENTS

| | | | | | |
|---|---|---|---|---|---|
| 871,082 | A | * | 11/1907 | Brigham | 30/45 |
| 1,359,031 | A | | 11/1920 | Coffman | |
| 1,505,333 | A | | 8/1924 | Gray et al. | |
| 1,564,143 | A | | 12/1925 | Sekulitch et al. | |
| 1,582,320 | A | * | 4/1926 | Wahl | 30/221 |
| 2,142,084 | A | * | 1/1939 | Rand, Jr. | 30/43.2 |
| 2,246,586 | A | * | 6/1941 | Hanley | 30/43.92 |
| 2,265,383 | A | | 12/1941 | Martin | |
| 2,265,384 | A | * | 12/1941 | Martin | 30/43.92 |
| 2,269,058 | A | * | 1/1942 | Kirkland | 30/43.92 |
| 2,876,538 | A | * | 3/1959 | Wahl et al. | 30/210 |
| 3,136,058 | A | * | 6/1964 | Andis | 30/210 |
| 3,570,122 | A | * | 3/1971 | Williams | 30/210 |
| 3,874,079 | A | | 4/1975 | Waters et al. | |
| 4,989,324 | A | * | 2/1991 | Andis | 30/216 |

(Continued)

FOREIGN PATENT DOCUMENTS

| | | | |
|---|---|---|---|
| EP | 0707926 | A1 | 4/1996 |
| WO | 2005092579 | A1 | 10/2005 |

(Continued)

*Primary Examiner* — Hwei C Payer

(57) ABSTRACT

A shaving device includes cooperating hair cutting elements and a driver for driving the hair cutting elements. The shaving device is configured to allow for automatic contour following during its application on the skin of a user. At least one cutting element is pivotably arranged in the shaving device, wherein a pivot axis intersects at least one position where the cutting element is contacted by a driving member for imposing reciprocating movement on the cutting element.

13 Claims, 4 Drawing Sheets

U.S. PATENT DOCUMENTS

| | | | | |
|---|---|---|---|---|
| 5,606,799 | A * | 3/1997 | Melton | 30/216 |
| 6,357,118 | B1 | 3/2002 | Eichhorn et al. | |
| 6,769,180 | B2 | 8/2004 | Coffin | |
| 6,886,255 | B2 * | 5/2005 | Freas et al. | 30/43.91 |
| 6,935,028 | B2 * | 8/2005 | Cutting | 30/41.5 |
| 2001/0015016 | A1 * | 8/2001 | Pragt | 30/34.2 |
| 2002/0020063 | A1 * | 2/2002 | Pragt et al. | 30/34.2 |
| 2004/0181954 | A1 | 9/2004 | Follo et al. | |
| 2011/0167639 | A1 * | 7/2011 | Lau | 30/34.1 |

FOREIGN PATENT DOCUMENTS

| | | | |
|---|---|---|---|
| WO | 2006056950 | A1 | 6/2006 |
| WO | 2006067713 | A1 | 6/2006 |
| WO | 2008150804 | A1 | 12/2008 |

* cited by examiner

SHAVING DEVICE COMPRISING A PIVOTABLY ARRANGED ASSEMBLY OF CUTTING ELEMENTS

FIELD OF THE INVENTION

The present invention relates to a shaving device, comprising an assembly of at least two cutting elements which are movably arranged with respect to each other, and which are adapted to cooperate for the purpose of cutting through hair during operation of the device; driving means for letting the hair cutting elements perform a reciprocating movement with respect to each other during operation of the device; and at least one driving member, which is part of the driving means, and which serves for imposing a reciprocating movement on at least one of the cutting elements; wherein the cutting element is pivotable about a pivot axis.

The present invention also relates to a cutting element for use in a shaving device as mentioned, and to an assembly of at least two cutting elements for use in a shaving device as mentioned.

BACKGROUND OF THE INVENTION

A shaving device as defined in the opening paragraph is known, for example from U.S. Pat. No. 6,357,118. The shaving device as described in this publication is a dry shaving apparatus comprising a housing, a shaving head frame mounted on the housing, and a shaving head with at least two cooperating cutting elements, at least one of the cooperating cutting elements being a reciprocating cutting element. Furthermore, the shaving device comprises a supporting frame which is coupled to the housing. In particular, the supporting frame has two support arms for mounting the shaving head within the shaving head frame, and also has a function in defining a pivot axis. Between the shaving head frame and the two support arms of the supporting frame, a conical bearing is located, wherein a spring is provided for applying a spring force to the conical bearing. The shaving head is mounted and held for pivotal movement about the pivot axis by the conical bearing acted upon by the spring force of the spring element.

For the purpose of driving the reciprocating cutting element, the shaving device known from U.S. Pat. No. 6,357,118 comprises an electric drive mechanism being provided within the housing, and having a drive element for the transmission of a driving motion to the cutting element. The drive element is configured as a rotary shaft to which an eccentric drive configured as a double eccentric drive is secured in order to transmit the driving motion from the drive element, through an opening in a wall of the supporting frame, to an oscillatory bridge structure provided in the shaving head frame. The oscillatory bridge structure has a slot of a dovetail-type configuration in which a pin of the eccentric drive configured as a double eccentric drive engages. The supporting frame with the support arms provided thereon ensures an oscillatory motion of the shaving head in the direction of movement of the reciprocating cutting element in addition to ensuring, through conically formed joints, a pivotal motion of the shaving head about a pivot axis. With respect to the orientation of this pivot axis, it is noted that provided at the ends of the two support arms of the supporting frame is a respective cone, which is arranged such that the pivot axis extends through the apices of the cones with the shaving head in mounted condition.

A main function of the pivotable arrangement of the shaving head in the housing of the known shaving device as described above is allowing for contour following during use of the shaving device. Only very skilled users are able to moving and positioning a shaving device in such a way that the device is used to its full potential, wherein such users usually need a mirror to check their handling of the device. Therefore, it is desirable to have a shaving device which is adapted to automatically perform contour following by having an adjustable position of the cutting elements with respect to a housing of the device, as a level of performance of the device is related to the way in which cutting elements are placed on skin to be shaved.

The shaving device known from U.S. Pat. No. 6,357,118 is adapted to allow for automatic contour following. However, its construction is rather complex, which is related to the fact that a considerable number of components is involved in allowing for a pivoting movement of the shaving head in the housing of the device during use of the device. Also, it is true that the electric drive mechanism is mounted for oscillation by means of a pivot bearing. In view of the fact that this mechanism is relatively heavy, this does not contribute to convenient handling of the shaving device by a user.

WO 2005/092579 discloses a shaving apparatus having two hair cutting elements, wherein each of the hair cutting elements is provided with a row of substantially V-shaped teeth having cutting edges. A cutting opening is present between each pair of cooperating teeth and has a shearing angle between 0° and 30°. During operation of the shaving apparatus, the cutting openings are not entirely closed, as a result of which skin damage is considerably reduced.

A characteristic feature of the shaving apparatus known from WO 2005/092579 is that the stroke of the movement which is performed by the hair cutting elements with respect to each other during operation may be in a range of 10 μm tot 150 μm. To those familiar with shaving apparatus, it will be apparent that this is a relatively small stroke. In order to avoid a situation in which no stroke remains when the shaving apparatus is used and the cutting elements experience a load, a high stiffness of the cutting elements and a drive train of these elements is needed, for example, a stiffness which is at least 3 N/μm. In other words, in order to avoid deterioration of the shaving performance of the shaving apparatus, it is important that a stiffness of components and connections between components of the shaving apparatus is high, from a motor for providing a driving force to tips of the teeth of the hair cutting elements.

SUMMARY OF THE INVENTION

It is an object of the present invention to provide a shaving device in which it is possible for the drive train to be stiff to a high extent on the one hand, and in which it is possible to allow for automatic contour following on the other hand. It could be considered an option to have all of the driving means and the hair cutting elements to move as one. However, this option is not at all practical, as a driving source like a motor is relatively big and heavy. Also, if this option would be realized, the mass centre would be located so far away from an area of the shaving device which is intended for contacting skin during use of the device that the feel of the device is likely to be uncomfortable, and that the actual extent to which contour following is obtained is likely to be very limited.

At first sight, simply providing a hinge at a suitable position in the drive train may seem to be another feasible option, but this appears to be not practical either. In the first place, a functional power transfer that would need to pass such a hinge is high. There seems to be too much force on an interface between the drive train and the reciprocating cutting element to enable easy contour following. In fact, a force generated by the driving means would be creating high friction forces in rotation movement at the hinge. In the second place, most known stiff hinges occupy space which is valuable in a hand-held device such as a shaving device. Moreover, when such a hinge would be applied, it would not be possible to have the pivot axis close to the level of the skin without taking complex constructional measures.

The present invention achieves the object defined above by providing a much better solution than letting all of the driving means and the hair cutting elements move as one or applying a stiff hinge. In particular, the present invention provides a shaving device, comprising:

an assembly of at least two cutting elements which are movably arranged with respect to each other, and which are adapted to cooperate for the purpose of cutting through hair during operation of the device;

driving means for letting the hair cutting elements perform a reciprocating movement with respect to each other during operation of the device;

at least one driving member, which is part of the driving means, and which serves for imposing a reciprocating movement on at least one of the cutting elements on the basis of actual contact to the cutting element, wherein such a contact involves abutment of a contacting surface of the driving member against a contacting surface of the cutting element;

wherein the cutting element is pivotably arranged with respect to the driving member, about a pivot axis which intersects the contacting surfaces of the driving member and the cutting element.

The shaving device according to the present invention is a shaving device comprising means for driving at least one cutting element. In many practical cases, the shaving device may be an electric shaving device, wherein an electric motor and a suitable transmission are applied for imposing a desired movement on at least one cutting element. However, other embodiments are feasible, for example an embodiment in which fuel cells are applied.

The present invention provides a solution according to which a pivotable arrangement of the cutting element is obtained without loss of stiffness in the shaving device and without a need for moving a driving source. This is realized by letting the cutting element be pivotable about an axis which is intersecting positions where the cutting element is in contact with a member of the driving means of the shaving device. In this way, the stiffness of the drive train in the shaving device may be optimal, as there is still direct contact between the driving member and the cutting element. Another important advantage is that the pivot axis is close to skin level, so that contour following may take place in a most accurate manner. In a practical embodiment, the pivot axis about which the cutting element is pivotable is extending substantially parallel to a direction in which the cutting elements are movable with respect to each other, so that the contour following may take place in a way that feels natural to a user.

Preferably, in order to prevent that a pivoting movement of the cutting element is hindered too much by friction forces, one of the contacting surfaces of the driving member and the cutting element has a convex shape, wherein another of the contacting surfaces has a shape which is deviating from a concave shape that is complementary to the convex shape of the one of the contacting surfaces. By having contacting surfaces which are shaped such that they are only capable of touching each other over a relatively small area, it is achieved that the influence of friction forces may be kept relatively small as well, wherein a pivoting movement of the cutting element with respect to the driving member may be allowed for to an extent which is sufficiently free for contour following to actually take place. At the same time, stiffness at the contacting surfaces, as seen in the direction of the reciprocating movement of the cutting element, is high, only influenced by Herzian contact deformation.

In a practical embodiment, a relatively small area of contact may be achieved when one of the contacting surfaces of the driving member and the cutting element has a convex shape, and when another of the contacting surfaces has a shape which is substantially planar.

It is also possible that the contacting surface of one of the driving member and the cutting element is part of a relatively small contacting element that is attached to the one of the driving member and the cutting element, wherein both contacting surfaces are substantially planar. In such a case, a relatively small area of contact is achieved on the basis of the fact that the contacting element is relatively small. In fact, the dimensions of the contacting surface of the contacting element define the dimensions of the area of contact. It is preferred if the dimensions of the contacting surface of the contacting element are smaller than or equal to 0.6 mm, and it is even more preferred if these dimensions are smaller than 0.3 mm. The contacting element may be a small pin, which may be obtained by cutting off a small piece of a wire, for example.

The driving member may be arranged such as to contact the cutting element from a side, however, it is also possible that one of the driving member and the cutting element comprises a section for accommodating at least a portion of another of the driving member and the cutting element. For example, one of the driving member and the cutting element may be provided with a hole, and another of the driving member and the cutting element may comprise a pin which is adapted to be accommodated inside said hole. According to one possibility, such an arrangement may be force closed, which means that the pin is accommodated inside the hole with play, wherein the pin and a surface delimiting the hole are biased toward each other, so that contact between contacting surfaces of the driving member and the cutting element is guaranteed, and the driving member is capable of performing its function of imposing a reciprocating movement on the cutting element. According to another possibility, the arrangement may be form closed, which means that the pin is tightly fitted inside the hole. Naturally, in such a case, contact between contacting surfaces of the driving member and the cutting element is guaranteed under all circumstances.

In any case, according to the present invention, the cutting element is pivotable about an axis which intersects points where surfaces of the driving member and the cutting element are contacting each other. For example, when the driving member comprises a pin and the cutting element has a hole for receiving the pin, the pin may have a rectangular cross-section, and the hole may have an overall rectangular shape, wherein surfaces of the cutting element delimiting the hole in the direction of the reciprocating movement are convexly curved. In the case of a force closed arrangement, one side of the pin touches a top of one convex surface, and the cutting element is pivotable about an axis which is intersecting a position where surfaces of the driving member and the cutting element are touching each other. In the case of a form closed arrangement, each of two opposite sides of the pin touches a top of a convex surface, and the cutting element is pivotable about an axis which is intersecting positions where surfaces of the driving member and the cutting element are touching each other. In both cases, on the basis of the fact that contacts are established between a planar surface and a convex surface, friction forces are kept at a level that is low enough for useful contour following to take place, as has already been explained above.

The present invention relates to the shaving device as described in the foregoing, and furthermore to a cutting element for use in the shaving device. This cutting element may be provided with a hole for accommodating at least a portion of the driving member of the shaving device, in particular the portion having the contacting surface, wherein a portion of the surface delimiting the hole, in particular the portion which is intended to serve as the contacting surface of the cutting element, preferably has a convex shape for the reason of keeping the friction forces at a reasonable level, as mentioned earlier.

In many practical cases, a shaving device comprises a body and an assembly of at least two cutting elements, wherein the assembly of cutting elements may constitute a disposable part of the shaving device, which is therefore removably arranged with respect to the body. The present invention also relates to an assembly as mentioned, whether or not disposable, in particular an assembly comprising the cutting element as described in the preceding paragraph, i.e. the cutting element which is provided with a hole and a convexly shaped contacting surface.

The above-described and other aspects of the present invention will be apparent from and elucidated with reference to the following description of a shaving device according to the present invention.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
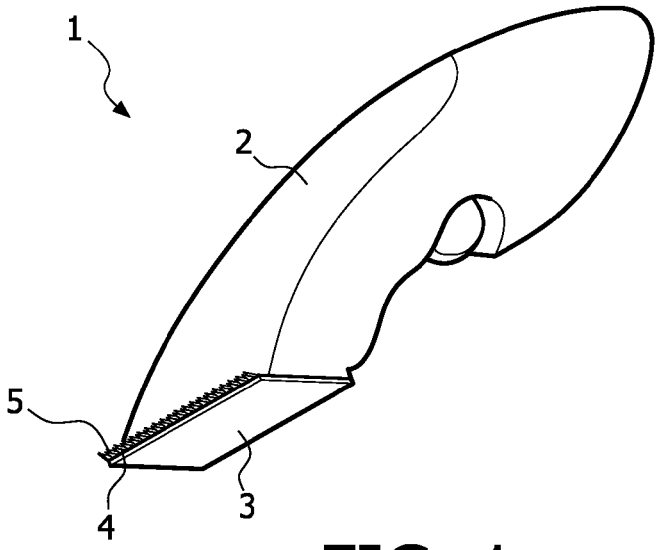
FIG. 1 shows a perspective view of a shaving device according to the present invention.

FIG. 1 shows a shaving device 1 according to the present invention, which comprises a body 2 and an assembly 3 of two elongated hair cutting elements 4, 5, wherein the said assembly 3 is mounted on the body 2.

For the purpose of performing a shaving action by means of the shaving device 1, a user of the shaving device 1 takes hold of the body 2 of the shaving device 1 and moves the assembly 3 of cutting elements 4, 5 across an area of skin where hair needs to be removed. During operation of the shaving device 1, the hair cutting elements 4, 5 are moved with respect to each other by driving means of the shaving device 1.

Figure 2:
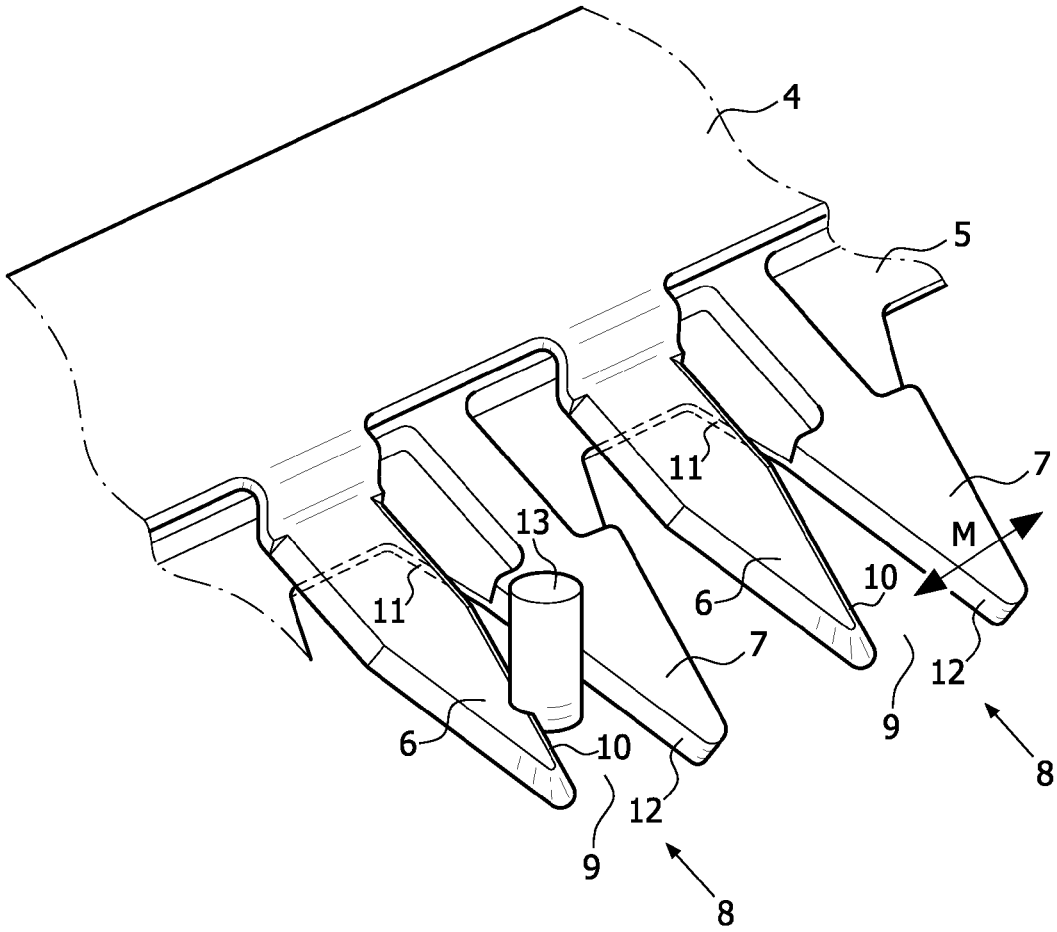
FIG. 2 shows a perspective view of portions of hair cutting elements of the shaving device as shown in FIG. 1.

In FIG. 2, portions of the hair cutting elements 4, 5 of the shaving device 1 are shown. Both hair cutting elements 4, 5 comprise a row of substantially V-shaped teeth 6, 7. In the assembly 3 of hair cutting elements 4, 5, the hair cutting elements 4, 5 are mounted such that teeth 6, 7 of one of the hair cutting elements 4, 5 are located in spaces between teeth 6, 7 of another of the hair cutting elements 4, 5. Hence, pairs 8 of teeth 6, 7 of the two hair cutting elements 4, 5 may be discerned. Cutting openings 9 which are convergent in a direction toward bases of the teeth 6, 7 are present between the teeth 6, 7 of one pair 8.

During operation of the shaving device 1, the hair cutting elements 4, 5 are driven such as to perform a reciprocating movement with respect to each other, in a direction in which the rows of teeth 6, 7 are extending. Due to this movement, which is indicated by means of a double-headed arrow M in FIG. 2, the size of cutting openings 9 between the teeth 6, 7 is continuously varied. In one extreme position of the hair cutting elements 4, 5 with respect to each other, the cutting opening 9 is largest, whereas in another extreme position of the hair cutting elements 4, 5 with respect to each other, the cutting opening 9 is smallest. A shaving action involves catching hair in the cutting openings 9, to which end the user of the shaving device 1 needs to move the assembly 3 of cutting elements 4, 5 across the skin, and decreasing the size of the cutting openings 9.

The teeth 6, 7 of both hair cutting elements 4, 5 are provided with cutting edges 10, 11 for the purpose of actually cutting through hair. In each pair 8 of teeth 6, 7, the cutting edges 10, 11 of the teeth 6, 7 are facing each other. The teeth 7 of one of the cutting elements 4, 5 are provided with non-cutting edges 12 as well. These edges 12 serve for supporting hairs 13 which get notched by means of the cutting edges 10 of the teeth 6 of the other hair cutting element 4.

Figure 3:
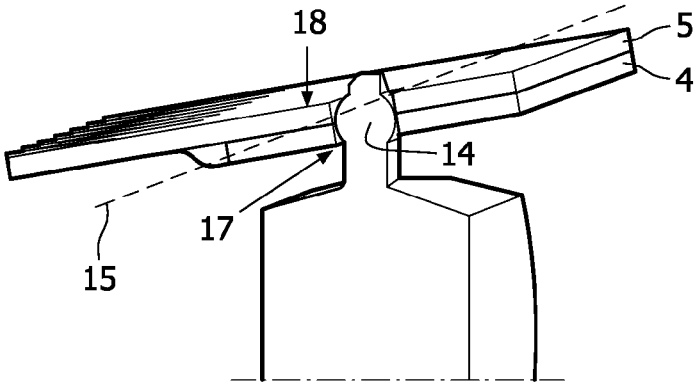
FIGS. 3 and 4 diagrammatically show a cross-section of components of the shaving device as shown in FIG. 1, in particular hair cutting elements and means for supporting and driving the hair cutting elements, in various positions with respect to each other.
Figure 4:
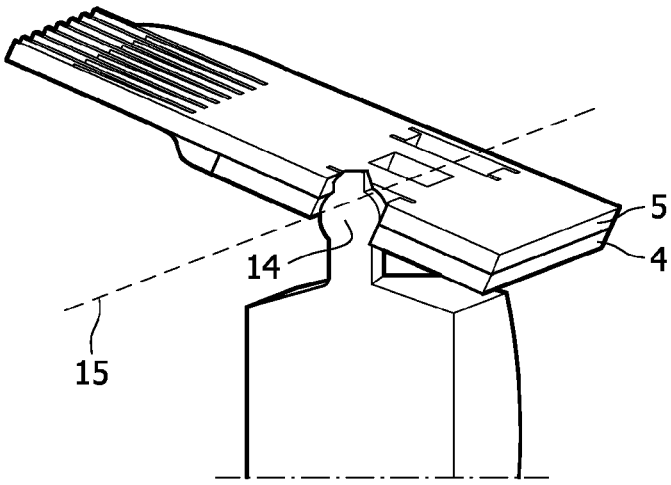

The effectiveness of a shaving action which is performed by means of the shaving device 1 is closely related to a position of the cutting elements 4, 5 with respect to the skin. In view of this fact, in the shaving device 1 according to the present invention, the assembly 3 of cutting elements 5, 6 is mounted such as to be pivotable with respect to the body 2, about a pivot axis which, in the shown example, is extending in a direction of the relative movement of the hair cutting elements 4, 5. During a shaving action, a user moves the shaving device 1 with respect to the skin, wherein he/she keeps the body 2 in positions which he/she feels are appropriate for a proper functioning of the shaving device 1. In this way, a position of the assembly 3 of cutting elements 4, 5 with respect to the skin is roughly defined. However, an accurate adaptation of the position of the said assembly 3 with respect to the skin is obtained on the basis of contact between the assembly 3 and the skin. In the process, it is possible for the assembly 3 to follow a contour of the skin, independent of the position of the body 2 with respect to the skin to a certain extent, as the assembly 3 is free to pivot with respect to the body 2. In FIGS. 3 and 4, two different positions of the assembly 3 of hair cutting elements 4, 5 with respect to a member 14 for driving the hair cutting elements 4, 5, which is associated with the body 2, are shown.

In the shaving device 1 having the arrangement of the hair cutting elements 4, 5 as illustrated by FIG. 2, a stroke of the reciprocating movement of the hair cutting elements 4, 5 with respect to each other is relatively small. For example, the stroke may be about 100 μm, wherein the two hair cutting elements 4, 5 have a freedom to move with respect to each other in the order of magnitude of about 130 μm. Furthermore, a frequency of the movement of the hair cutting elements 4, 5 may be about 200 Hz. In order to maintain the stroke during shaving actions, a relatively high drive stiffness is needed. In view of this, the stiffness is preferably higher than 3 N/μm.

The shaving device 1 according to the present invention has both a pivoting arrangement of the hair cutting elements 4, 5 and a relatively high drive stiffness. This is achieved by letting the hair cutting elements 4, 5 be pivotable about an axis which is intersecting a position where at least one of the hair cutting elements 4, 5, for example a hair cutting element 5 which is intended to be positioned closest to the skin, contacts the driving member 14. In the figures, the pivot axis is indicated by a dash and dot line 15. In the following, the hair cutting element 5 which is intended to be positioned closest to the skin will also be denoted as top hair cutting element 5.

Due to the fact that a position of the pivot axis 15 is determined by a position of contact between the driving member 14 and a hair cutting element 5, it is achieved that the pivot axis 15 is close to the skin during use of the shaving device 1, so that optimal contour following is possible. Furthermore, there is no need for heavy and/or bulky components in order to allow for contour following and the associated pivoting movements.

Figure 5:
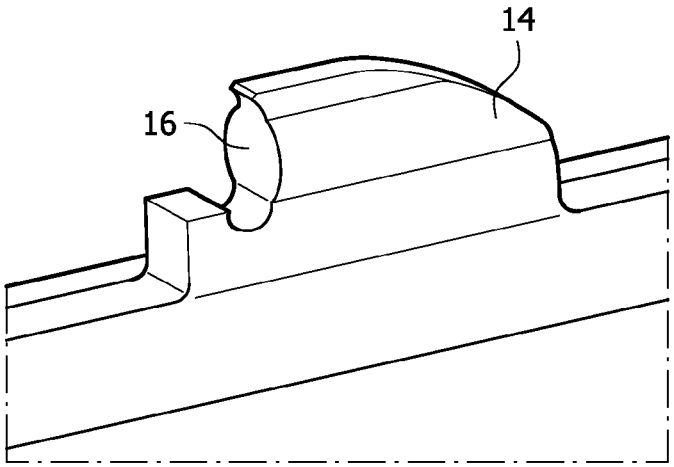
FIG. 5 diagrammatically shows a perspective view of a member of the driving means as shown in FIGS. 3 and 4, which serves for imposing a movement on the cutting elements on the basis of actual contact to the cutting elements.

The driving member 14 is shown in more detail in FIG. 5. In a practical embodiment, the shaving device 1 comprises at least two of these driving members 14 for mounting the assembly 3 of hair cutting elements 4, 5 on the body 2. The driving members 14 are at the end of a drive train of the shaving device 1, and are adapted to actually impose a reciprocating movement on the hair cutting elements 4, 5 by abutting against these elements 4, 5. In FIG. 5, a surface of the driving member 14 which is intended for contacting the hair cutting elements 4, 5 is indicated by reference numeral 16. The driving member 14 as shown is suitable for supporting and driving both hair cutting elements 4, 5. For sake of completeness, it is noted that this is not an essential feature of the driving member 14.

Figure 6:
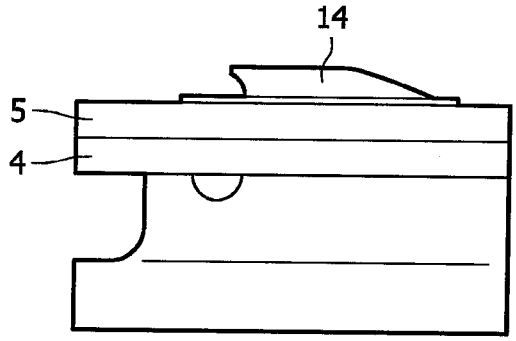
FIG. 6 diagrammatically shows a cross-section of the driving member as shown in FIG. 5 and cutting elements mounted on the driving member.
Figure 7:
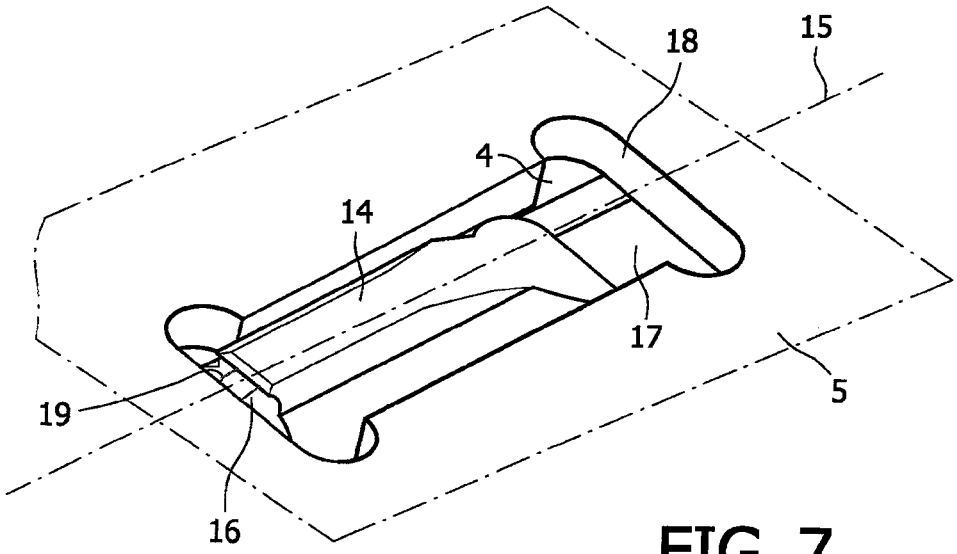
FIG. 7 diagrammatically shows a perspective view of the driving member and portions of the cutting elements mounted thereon as shown in FIG. 6.

In the shown example, the cutting elements 4, 5 have elongated holes 17, 18 for receiving a portion of the driving members 14, and the cutting elements 4, 5 are mounted on the driving members 14 while being positioned on top of each other, wherein a portion of the driving members 14 is extending like a pin through the holes 17, 18. The mounted arrangement as described is clearly illustrated by FIGS. 6 and 7. The holes 17, 18 of the cutting elements 4, 5 may be seen in FIG. 7. FIG. 7 furthermore shows a position of a driving member 14 and the top hair cutting element 5 in which the contacting surface 16 of the driving member 14 is in contact with a contacting surface 19 of the hair cutting element 5, which is a delimiting surface of the hole 18 in the hair cutting element 5, in the direction of the reciprocating movement. In this position, on the basis of the contact as mentioned, the driving member 14 is capable of imposing a reciprocating movement on the hair cutting element 5. Resilient means (not shown) like a spring may be used for pressing the driving member 14 against the contacting surface 19 of the hair cutting element 5, so that a position in which the contacting surfaces 16, 19 of the driving member 14 and the hair cutting element 5 are touching each other is a default position.

Figure 8:
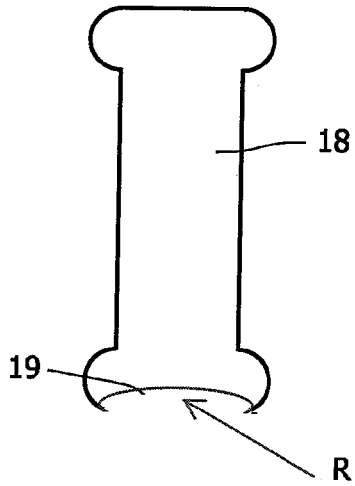
FIG. 8 diagrammatically shows a contour of a hole of a cutting element as shown in FIGS. 6 and 7.

Advantageously, the contacting surface 19 of the hair cutting element 5 is convexly curved, as is illustrated by FIG. 8, in which a radius R of the contacting surface 19 is indicated. In case the contacting surface 19 would be planar, there would be a significant amount of friction between the driving member 14 and the hair cutting element 5, assuming that the contacting surface 16 of the driving member 14 is substantially planar as well, as is the case in the shown example. By reducing the area of contact, only a small friction moment is generated when the hair cutting member 5 is made to pivot with respect to the driving member 14 under the influence of contact to a portion of skin during a shaving action, wherein this small friction moment may be sufficiently small to allow for the required contour following. Still, in the shown arrangement, the stiffness in the direction of the reciprocating movement of the hair cutting elements 4, 5 is high, only influenced by Herzian contact deformation. In view of this, a minimum value of the radius of the contacting surface 19 is determined by a minimum stiffness that needs to be realized, while taking into account Herzian contact stresses occurring when the radius is applied.

With respect to the advantageous option of having a convexly curved contacting surface 19 of the hair cutting member 5, it is noted that in general, it is advantageous to let the contact between the driving member 14 and the hair cutting member 5 be a contact between a substantially planar surface and a convexly curved surface. In any case, in order to reduce friction forces to such an extent that contour following is possible, it is preferred not to use a combination of a convexly curved surface and a matching concavely curved surface, wherein contact between the surfaces takes place over a relatively large area. It is not necessary that the hair cutting member 5 is provided with a convexly curved surface 19 and that the driving member 14 has a substantially planar surface 16, and it is also possible to have it the other way around.

Figure 9:
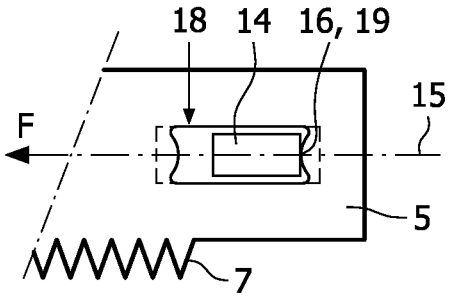
FIGS. 9, 10, 11 and 12 illustrate two different options in respect of an arrangement of the driving member and the cutting elements as shown in FIGS. 6 and 7.
Figure 10:
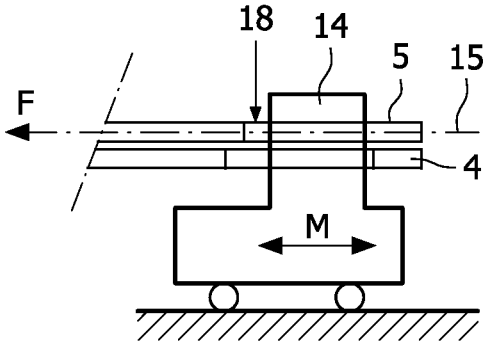
Figure 11:
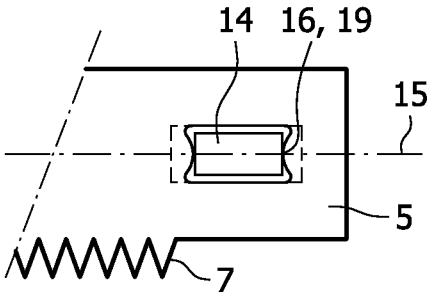
Figure 12:
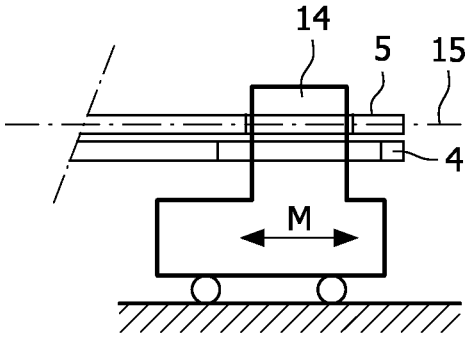

The arrangement in which the driving member 14 and a surface 19 of the hair cutting element 5 are biased toward each other is also known as force closed arrangement. A diagrammatic depiction of the driving member 14 and portions of the hair cutting elements 4, 5 in such an arrangement is given in FIGS. 9 and 10, wherein a reciprocating movement of the driving member 14 is indicated by means of a double-headed arrow M, and wherein a force for pulling the top hair cutting element 5 against the driving member 14 is indicated by means of a single-headed arrow F.

In order to have an even further reduced friction during a pivoting movement, the arrangement may be form closed instead of force closed. In a form closed arrangement, the driving member 14 is tightly fitted inside the hole 18 of the hair cutting member 5, so that an average force on contacting surfaces 16, 19 of the driving member 14 and the hair cutting element 5 is low, compared to the pre-stressed, force closed option.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such an illustration and description are to be considered illustrative or exemplary only, and not restrictive. The present invention is not limited to the disclosed embodiments.

For sake of completeness, it is noted that the wording "shaving device" as used in this text should be understood such as to cover various types of appliances for shaving portions of skin by cutting off hair close to the skin, including shavers, trimmers, grooming appliances and female depilation appliances.

The shaving device 1 according to the present invention is adapted to allow for automatic contour following during its application on the skin of a user. In particular, at least one cutting element 4, 5 is pivotably arranged in the shaving device 1, wherein a pivot axis 15 is intersecting at least one position where the cutting element 4, 5 is contacted by a driving member 14 for imposing the reciprocating movement on the cutting element 4, 5. In this way, a high drive stiffness is guaranteed, which is particularly important when a stroke of the movement of the cutting element 4, 5 is relatively small, for example, in an order of 100 μm. In order to avoid a situation in which the function of contour following is significantly hindered by friction moments, it is preferred if the contact between the driving member 14 and the hair cutting element 4, 5 involves the contact of a convexly curved surface to a surface having a shape which is deviating from a complementary concave shape, such as a substantially planar shape.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The invention claimed is:

1. A shaving device, comprising:

an assembly of at least two cutting elements which are movably arranged with respect to each other, and which are adapted to cooperate for the purpose of cutting through hair during operation of the shaving device;

a driver configured to let the at least two cutting elements perform a reciprocating movement with respect to each other during operation of the shaving device;

at least one driving member, which is part of the driver, and which serves for imposing the reciprocating movement on at least one cutting element of the cutting elements based on contact with the at least one cutting element, wherein the contact involves abutment of a first contacting surface of the driving member against a second contacting surface of the at least one cutting element;

wherein the at least one cutting element is pivotably arranged with respect to the driving member, about a pivot axis which intersects the first and second contacting surfaces of the driving member and the at least one cutting element, wherein the at least one cutting element has a hole for accommodating at least a member portion of the driving member of the shaving device, wherein the member portion has the first contacting surface, and wherein contacting portions of a surface delimiting the hole has a convex shape, the contacting portions being intended to serve as the second contacting surface of the at least one cutting element and being opposite each other defining opposite surfaces delimiting the hole.

2. The shaving device according to claim 1, wherein the pivot axis about which the at least one cutting element is pivotable extends substantially parallel to a direction in which the at least two cutting elements are movable with respect to each other.

3. The shaving device according to claim 1, wherein one of the contacting surfaces of the driving member and the at least one cutting element has a convex shape, and wherein the other of the contacting surfaces has a shape which is deviating from a concave shape that is complementary to the convex shape of the one of the contacting surfaces.

4. The shaving device according to claim 1, wherein one of the contacting surfaces of the driving member and the at least one cutting element has a convex shape, and wherein the other of the contacting surfaces has a shape which is substantially planar.

5. The shaving device according to claim 1, wherein one of the driving member and the at least one cutting element comprises a section for accommodating at least a portion of the other of the driving member and the at least one cutting element.

6. The shaving device according to claim 5, wherein the portion of the other of the driving member and the at least one cutting element that is accommodated inside the section of the one of the driving member and the at least one cutting element is accommodated inside said section with play, and wherein said portion and one of the first contacting surface of the one of the driving member and the second contacting surface of the at least one cutting element are biased toward each other.

7. The shaving device according to claim 5, wherein the portion of the other of the driving member and the at least one cutting element that is accommodated inside the section of the one of the driving member and the at least one cutting element is tightly fitted inside said section.

8. The shaving device of claim 1, wherein the contacting portions having the convex shape extend between a front cutting portion of the at least one cutting element and a back portion of the at least one cutting element opposite the front cutting portion.

9. The shaving device of claim 1, wherein a dimension of at least one of the first contacting surface and the second contacting surface is smaller than or equal to 0.6 mm.

10. An assembly for use in a shaving device, comprising:

at least two cutting elements being movably arranged with respect to each other, and which are adapted to cooperate for cutting hair during operation of the shaving device;

a driver configured to let the at least two cutting elements perform a reciprocating movement with respect to each other during operation of the shaving device;

at least one driving member, which is part of the driver, and which serves for imposing the reciprocating movement on at least one cutting element of the cutting elements on the basis of actual contact with the at least one cutting element, wherein such a contact involves abutment of a first contacting surface of the driving member against a second contacting surface of the at least one cutting element;

wherein the at least one cutting element is pivotably arranged with respect to the driving member, about a pivot axis which intersects the contacting first and second surfaces, wherein the at least one cutting element has a hole for accommodating at least a member portion of the driving member of the shaving device, wherein the member portion has the first contacting surface, and wherein contacting portions of a surface delimiting the hole has a convex shape, the contacting portions being intended to serve as the second contacting surface of the at least one cutting element and being opposite each other defining opposite surfaces delimiting the hole.

11. The assembly of claim 10, wherein the contacting portions having the convex shape extend between a front cutting portion of the at least one cutting element and a back portion of the at least one cutting element opposite the front cutting portion.

12. The assembly of claim 10, wherein a dimension of at least one of the first contacting surface and the second contacting surface is smaller than or equal to 0.6 mm.

13. A shaving device, comprising:

an assembly of at least two cutting elements which are movably arranged with respect to each other, and which are adapted to cooperate for the purpose of cutting through hair during operation of the shaving device;

a driver configured to drive the at least two cutting elements to perform a reciprocating movement with respect to each other during operation of the shaving device; and at least one driving member, which is part of the driver, and which serves for imposing the reciprocating movement on at least one cutting element of the cutting elements on the basis of actual contact with the at least one cutting element, wherein such a contact involves abutment of a first contacting surface of the driving member against a second contacting surface of the at least one cutting element;

wherein the at least one cutting element is pivotably arranged with respect to the driving member, about a pivot axis which intersects the contacting surfaces of the driving member and the at least one cutting element, wherein one of the first contacting surface and the second contacting surface is part of a relatively small contacting element that is attached to the one of the driving member and the at least one cutting element, wherein both contacting surfaces are substantially planar, and wherein dimensions of the contacting surface of the contacting element are smaller than or equal to 0.6 mm.

* * * * *